United States Patent [19]

Corry

[11] Patent Number: 5,004,191

[45] Date of Patent: Apr. 2, 1991

[54] RAIN GUTTER SUPPORT AND MOUNTING BRACKET

[76] Inventor: Durrell Corry, 18371 Edgewood, Villa Park, Calif. 92667

[21] Appl. No.: 418,490

[22] Filed: Oct. 10, 1989

[51] Int. Cl.[5] ..... E04D 13/00

[52] U.S. Cl. ..... 248/48.2; 52/11

[58] Field of Search ..... 248/48.1, 48.2; 52/11, 52/12, 15

[56] References Cited

U.S. PATENT DOCUMENTS

| | | | |
|---|---|---|---|
| 3,022,029 | 2/1962 | Blayden | 248/48.2 |
| 3,150,851 | 9/1964 | Ritchie et al. | 248/48.2 |
| 3,239,172 | 3/1966 | Chalmers | 52/11 X |
| 3,296,749 | 1/1967 | Cotter | 52/11 |
| 3,416,760 | 12/1968 | Sauder | 248/48.2 |
| 3,426,987 | 2/1969 | Leslie | 248/48.2 |
| 3,752,428 | 8/1973 | Trostle et al. | 248/48.2 |
| 4,241,548 | 12/1980 | Rowe | 52/11 |
| 4,294,422 | 10/1981 | Odekirk | 248/48.2 |

FOREIGN PATENT DOCUMENTS

| | | | |
|---|---|---|---|
| 1077232 | 5/1980 | Canada | 248/48.1 |

*Primary Examiner*—David L. Talbott

*Attorney, Agent, or Firm*—Gary Appel

[57] ABSTRACT

A support and mounting bracket is provided for rain gutters having an exposed side and a mounting side, the mounting side having formed at the upper end an L-shaped lip with a horizontal surface and a vertical surface. The support and mounting bracket comprises an elongate, slender and substantially straight body portion which terminates at an outer end portion with at least a lower ramping surface which aids in the installation of the bracket into a rain gutter, the inner end portion being also configured for fitting within the lip of the rain gutter so as to support the exposed side of the rain gutter. The body of the bracket terminates at an inner end portion having a hooked region into which an upper edge of the mounting side of the rain gutter fits upwardly, such inner end region being formed with a downwardly and outwardly inclined aperture through which an elongate attachment, such as a nail or a screw, can be installed to mount the rain gutter to a facia plate or the like. The inner end portion is constructed having a transverse bead at lower regions thereof to help retain the inner end portion onto the upper edge of the mounting side of the rain gutter. Preferably, the bracket is constructed of a transverse cross sectional section of an aluminum extrusion, but may alternatively be constructed of a rigid, tough plastic which contains one or more ultraviolet inhibitors to protect the bracket from degradation due to prolonged exposure to sunlight.

8 Claims, 1 Drawing Sheet

RAIN GUTTER SUPPORT AND MOUNTING BRACKET

BACKGROUND OF THE INVENTION

1. Field of the Invention

The present invention relates generally to the field of rain gutters, especially rain gutters used for residential homes, and, more particularly, to brackets for mounting such rain gutters to facia plates, exposed ends of roof rafters, or the like.

2. Discussion of the Prior Art

It is known, even to the most casual observers, that most residential homes, as well as apartments, condominiums, and many other types of buildings, have rain gutters installed under the eves collect rain running off the roofs and direct such runoff to downspouts. In particular, rain gutters are commonly used over entries and windows so as to prevent the runoff from roofs from pouring down onto persons entering and leaving the building and to prevent possible water leakage around doors and windows, as might otherwise occur in the absence of rain gutters which divert roof runoff away therefrom.

Rain gutters are commonly constructed of sheet metal, such as aluminum or galvanized steel. In some instances, however, rain gutters may be constructed of a strong, thin plastic material, such as PVC, polycarbonate, or fiberglass.

Typically, rain gutters are more or less rectangular in transverse cross section, but may be sculptured in shape to provide an aesthetic appearance and to provide greater longitudinal stiffness. To provide greater longitudinal stiffness, at least the outer upper edge of most rain gutters is bent into an inverted J-shape to provide a narrow, inwardly and downwardly extending lip. For residential use, rain gutters are typically about four to five inches in width and are about four inches deep; although, larger sizes may be used for commercial and industrial buildings.

Rain gutters are attached to facia plates (or to exposed ends of rafters) by a variety of different types of attachments. One of the most common—and presumably the least expensive—type of rain gutter attachment merely comprises a long, common nail and a tubular spacer having a length equal to the inner width of the rain gutter at its top, the nail being substantially longer than the tubular spacer. With the spacer in place to prevent collapse of the rain gutter, the nail is driven through the outer (exposed) side of the rain gutter, near its upper edge, through the inside of the spacer, through the back (mounting) side of the rain gutter, then into the facia plate (or exposed rafter end).

Although easy to use and inexpensive, such nail and spacer rain gutter attachments have several significant disadvantages. Primarily such attachments usually do not provide a very strong said rigid gutter support and attachment of the rain gutter to the facia plate (or rafter end). Especially in regions of the country where snow and ice collect in the rain gutters in the winter, the long nails used in such nail and spacer attachments bend under the weight of the snow and ice in the rain gutter, thereby permitting the rain gutter to sag in an unsightly and ineffective manner. However, even in regions of the country which do not have snow and ice in the winter, the exposed nail heads of the nails used in nail and spacer rain gutter attachments are unsightly. This especially is the case for single story homes having relatively low and exposed eves over entryways, where the rain gutters are readily visible.

Consequently, different types of rain gutter attachment means have been devised. For example, U.S. Pat. No. 4,294,422, which was issued on Oct. 13, 1981 to Wm. Odekirk, discloses a one piece gutter hanger bracket which is constructed of a bent-up piece of sheet metal strip. As disclosed, the hanger bracket has an upwardly and outwardly inclined nail guide portion in its midsection, which enables a mounting nail to be driven through the bracket at a slant so that the nail is accessible for driving without damaging the rain gutter or being visible from below.

While such hanger bracket for rain gutters appears to be an improvement over the above-described, simple nail and spacer attachment, it nevertheless seems to have some disadvantages. As an example, the hanger bracket has, as depicted in FIGS. 1 and 2 of the Odekirk patent, about twelve bends. Special, costly equipment would, therefore, seem to be needed to make large production quantities of such brackets. Moreover, care must be taken when attaching rain gutters using the disclosed hanger brackets, for if the attaching nail is driven into the facia plate with too great a force, the nail guide portion of the bracket can be easily collapsed, thereby requiring the pulling of the nail from the facia plate and replacement of the hanger bracket and possibly also the section of the rain gutter being installed. Still further, because the disclosed hanger bracket is constructed of bent-up sheet metal, it is subject to bending under snow and ice loading of the rain gutter with which it is used.

For these and other reasons, the need still exists for a sturdy, inexpensive, easily installed, fool-proof rain gutter support and mounting bracket, and it is a principal objective of the present invention to provide such an improved support and mounting bracket for rain gutters. Also, the nail in the bracket is very difficult to hit if there is too much roof overhang, as the hammer hits the front of the rain gutter or roof.

SUMMARY OF THE INVENTION

In accordance with the present invention there is provided a rain gutter support and mounting bracket preferable configured for rain gutters having an exposed side and a mounting side, the mounting side having formed at the upper end an L-shaped lip with a horizontal surface and a vertical surface. THe support and mounting bracket, which is preferably constructed of an aluminum extrusion, comprises an elongate, slender and substantially straight right body portion which terminates at an outer end portion with an upwardly extending angle region configured for fitting within the lip of the rain gutter so as to support the exposed side of the rain gutter and which terminates at an inner end portion having a hooked region into which an upper edge of the mounting side of the rain gutter fits upwardly. It is preferred that the inner end portion be constructed having a transverse bead at lower regions thereof to help retain the upper edge off the mounting side of the rain gutter into the inner end portion of the bracket.

The inner end region is preferably formed with a downwardly and outwardly inclined aperture through which an elongate attachment, such as a nail or a screw, can be installed to mount the rain gutter to a building facia plate or the like.

In accordance with the preferred embodiment, the body portion of the support and mounting bracket is generally rectangular in transverse cross section, being, for example, about ½ inch wide and about 3/16 inch thick. It is also preferred that the outer end portion of the bracket is formed having at least a lower ramping surface which enables the bracket to be installed into a conventional rain gutter by first attaching the inner end region to an upper edge of the inner side of the rain gutter and then snapping the outer end region downwardly into the rain gutter by the action of such ramping surface pushing the upper edge region of the outer side of the rain gutter outwardly, the springiness of the rain gutter material thereafter causing the outwardly-ramped region of the rain gutter to spring back to its original shape when the bracket is fully inserted into the rain gutter.

In a variation, the support and mounting bracket is constructed of a rigid, tough plastic, preferably containing one or more ultraviolet inhibitors which protect the plastic from degradation due to prolonged exposure to sunlight.

BRIEF DESCRIPTION OF THE DRAWINGS

The present invention can be more readily understood by a consideration of the following detailed description when taken in conjunction with the accompanying drawings, in which:

FIG. 1 is a transverse cross sectional drawing of a prior art type of gutter attachment, such attachment comprising a long, common nail and a tubular spacer installed between opposing inside surfaces of a rain gutter and through which the nail is driven to nail the rain gutter to a facia plate or the like;

FIG. 3 transverse cross sectional drawing showing the manner in which the support and mounting bracket of FIG. 2 is used to attach a conventional rain gutter to a facia plate or the like.

Figure 3:
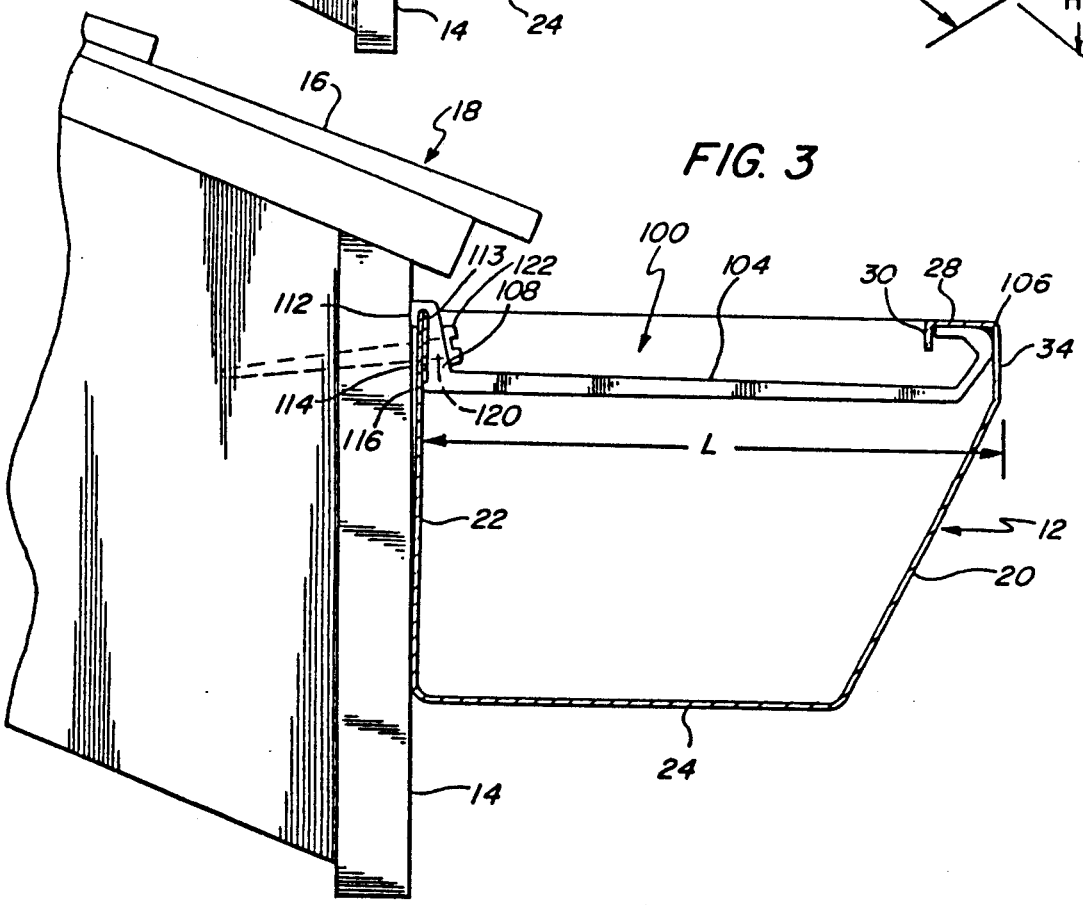
Figure 4:
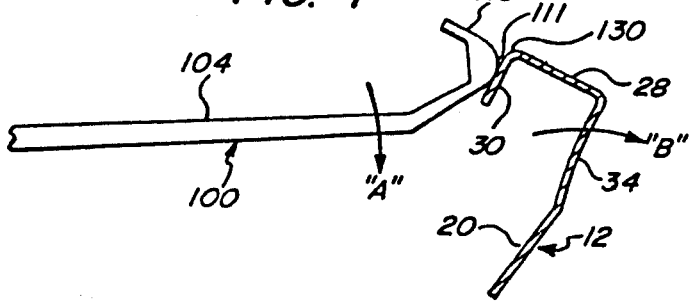

In the various FIGS. like elements and features are given the same reference number and/or other identification; and, FIG. 4 a partial transverse cross sectional drawing, similar to the right-hand portion of FIG. 3, but showing an outer end portion of the support and mounting bracket being snapped downwardly into an upper, outer region of the rain gutter.

In the various FIGS. like elements and features are given the same reference numbers and/or other identification.

DESCRIPTION OF THE PREFERRED EMBODIMENT

Figure 1:
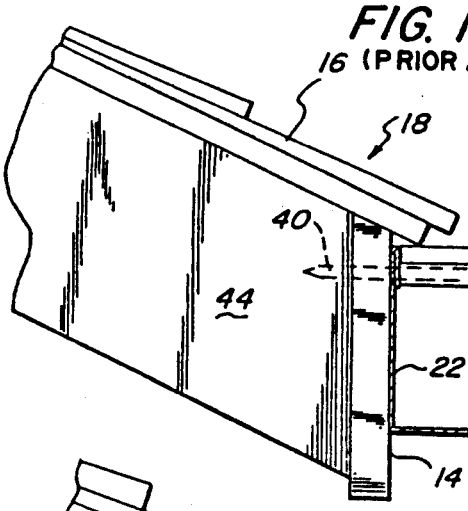
FIG. 1 (PRIOR ART)

There is depicted in FIG. 1, for illustrative purposes, a prior art type of rain gutter support and mounting or attachment means which is shown used to mount a generally conventional rain gutter 12 to a building facia plate 14. Attachment means 10 mount rain gutter 12 to facia plate 14 so that the rain gutter is positioned below a projecting roof 16 of a building 18 to which the facia plate is mounted. Consequently, rain water runoff from roof 16 falls into rain gutter 12 and is fl©wed thereby to one or more downspouts (not shown).

As shown, rain gutter 12 comprises an outer (relative to building 18) side 20, a horizontal bottom 22 and a vertical inner (mounting) side 24, the rain gutter being substantially open at the top. Outer side 20 may, as shown, be downwardly and inwardly inclined, or may alternatively be sculptured to provide a pleasing appearance. An upper, outer edge of rain gutter 12 is formed in an inverted J shape so as to have a horizontal surface region 28 and a vertical surface portion 30, both of which function to add longitudinal stiffness to rain gutter 12. In the illustrated case wherein outer side 20 of rain gutter 12 is formed at a slant, an upper region 34 thereof is formed or bent so as to be vertical.

It is to be appreciated that as used herein such terms as horizontal, vertical, upward, downward, and inward refer to directions relative to rain gutter 12 being installed, as depicted in FIG. 1, in a normal manner on facia plate 14.

Prior art attachment means 10 comprises a long, common nail 40, which may be of 6d or 8d size and which may be about 6–8 inches long. Further comprising attachment means 10 is a tubular spacer 42 having a length equal to the separation between upper regions of outer and inner sides 20 and 22, respectively. The inside diameter of spacer 42 is ordinarily made just large enough to permit nail 40 to freely pass therethrough. Spacer 42 is sufficiently strong and rigid so that it supports nail 40 as the nail is driven therethrough into facia plate 14, Or the exposed end of a rafter 44 if no facia plate is used, so that the nail does not bend.

Typically when attachment means 10 are to be used, rain gutter 12 has pre-drilled or pre-punched holes (not shown) in upper regions of outer and inner sides 20 and 22, at appropriate longitudinal spacing, through which nail 40 passes. Alternatively nail 40 may be driven through sides 20 and 22 of rain gutter 12 at the time the rain gutter is mounted to facia plate 14.

THE PRESENT INVENTION

Figure 2:
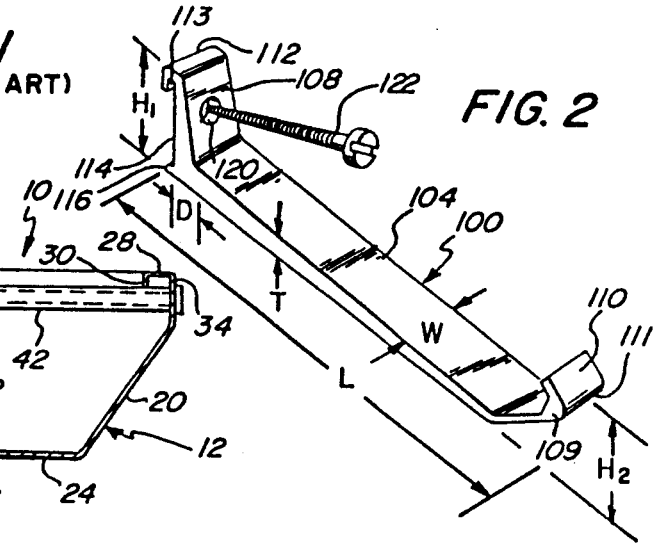
FIG. 2 is a perspective of a rigid, extruded aluminum rain gutter support and mounting bracket In accordance with a preferred embodiment of invention.

In FIG. 2 there is illustrated an improved rain gutter support and mounting bracket 100, which can, as shown, be out from a length of aluminum extrusion 102 (shown in phantom lines). That is, extrusion 102 can be cut across at intervals equal to the width, w, of bracket 100 so as to form a number of the brackets.

Extrusion 102 is formed so that support and mounting bracket 100 has a length, L, which is at least about equal to the distance between upper regions of outer and inner sides 20 and 22, respectively, of rain gutter 12 (FIG. 3). Preferably, however, the length, L, of bracket 100 may be slightly greater than the distance between rain gutter sides 20 and 22 so that, during installation, the brackets are temporarily held in place by the springiness of rain gutter 12.

Although support and mounting bracket 100, as shown in FIGS. 2 and 3, is made of a single piece of metal, it can be considered, for purposes of description, as comprising an elongate body portion 104, an outer end portion 106, and an inner end portion 108. Outer end portion 104 is preferably formed inn the general shape of a reversed "C" which is sized to fit within an upper region of rain gutter outer side defined by surface regions 34, 28, and 30 (FIG. 3). For reasons described below, outer end portion 104 is constructed having an upwardly and outwardly (away from facia plate 14) ramping portion 109 and an upper, downwardly and outwardly sloping ramping portion 110. Ramping portions 109 and 110 meet at a relatively small radiused region 111.

Inner end portion 108 of bracket 100 is made generally triangular in shape as viewed from a side of the bracket, being in lower regions where such portion joins body portion 104 (FIG. 2). An upper region 112 of inner portion 108 is formed having an upwardly extending slot 113 into which an upper edge region of rain gutter inner side 22 is received when bracket 100 is used to attach rain gutter 12 to a facia plate 14 or the like (FIG. 3).

Formed along the lower edge of a back surface 114 of inner portion 108 is a transverse bead 116 which helps hold bracket 100 between outer and inner sides 20 and 22 of rain gutter 12 during the rain gutter attachment process and which helps hold the upper edge of inner side 22 of rain gutter 12 in slot 113. These actions are achieved by bead 116 causing inner side 22 to bend out slightly over the bead, thereby tending to wedge the upper edge of the inner side into slot 113.

A downwardly slanting aperture 120 is formed through inner portion 18 of bracket 12 to receive an attachment member 122, such as a screw or nail (FIGS. 2 and 3) when bracket 100 is used to attach rain gutter 12 to a facia plate 14 or the like.

As above described, outer end portion 106 of bracket 1030 is formed having respective lower and upper ramping portions 109 and 110. As depicted in FIG. 4, such ramping surfaces aid in the insertion of bracket 100 into rain gutter 12 when the upper edge of rain gutter inner side 22 is received into slot 113. In such case, bracket 100 is rotated downwardly (direction of arrow "A") in a manner causing lower ramping portion 109 to engage an upper, inner corner 130 at the intersection of regions 28 and 30 of rain gutter 12. As inner portion 106 of bracket 100 is pushed downwardly relative to rain gutter 12, lower ramping portion 109 causes the upper edge of rain gutter 12 to flex outwardly (direction of arrow "B") until outer end portion 106 snaps downwardly past rain gutter portion 330 and inside of the rain gutter. Thereafter, the natural springiness of rain gutter 12 causes its upper, outer edge to spring back to its original shape. Upper ramping portion 110 of bracket outer end portion 106 further aids is enabling the outer portion of bracket 100 to slip past the outer, upper edge of rain gutter 12.

Although dimensions of support and mounting bracket 100 will usually vary according to the size of rain gutter 12, for most common rain gutters (which are of a generally standard size, although shape and appearance ma vary) is about 5 inches in length, L. Width, W, of body portion 104 may be about ½ inch and a thickness, T, of the body portion may be about 3/16 inch. Height, $H_1$, of inner portion 108 of bracket 100 may be about 1 1/8 inches. The base of inner portion 108 may have a depth, D, of about ½ inch. A height, $H_2$, of outer portion 106 may be about ½ inch.

In general, the dimensions of support and mounting bracket 100 are selected to enable the bracket to be strong and rigid, while minimizing the amount of material required.

Although there is described above a specific arrangement of a rain gutter support and mounting bracket in accordance with the present invention for the purpose of illustrating the manner in which the invention can be used to advantage, it is to be appreciated that the invention is not limited thereto. For example, supporting and mounting bracket 100 may alternatively be constructed in essentially the same configuration as above described, by the injection molding of a strong rigid plastic, such as PVC or polypropylene, or from a fiberglass reinforced resin. In such case, plastic material preferably contains an ultraviolet inhibitor, as is well known in the plastics art, to prevent degradation of the bracket by prolonged exposure to sunlight. Accordingly, any and all variations and modifications which may occur to those skilled in the art are to be Considered to be within the scope and spirit of the invention as defined by the appended claims.

What is claimed is:

1. A support and mounting bracket for rain gutters having an exposed side and a mounting side, said mounting side having formed at the upper end an L-shaped lip with a horizontal surface and a vertical surface, said support and mounting bracket comprising an elongate, slender and substantially straight body portion which terminates at an outer end portion with an upwardly extending angle region configured for fitting within said lip of the rain gutter so as to support the exposed side of the rain gutter and which terminates at an inner end portion having a hooked region into which an upper edge of the mounting side of the rain gutter fits upwardly, said outer end portion of the bracket body portion being formed having a lower ramping surface means which is sloped upwardly and outwardly for encircling the bracket outer end portion to be pushed downwardly past an upper, outer edge region of a rain gutter when the upper edge of the mounting side of the rain gutter is positioned in the hooked region of the bracket inner end portion, said ramping surface flexing regions of said upper edge region of the rain gutter outwardly and said inner end region being formed with a downwardly and outwardly inclined aperture through which an elongate attachment, such as a nail or screw, can be installed to mount the rain gutter to a facia plate or the like.

2. The support and mounting bracket as claimed in claim 1, wherein said bracket is constructed to a transverse cross sectional section of an aluminum extrusion.

3. The support and mounting bracket as claimed in claim 1, wherein said bracket is constructed of a rigid, tough plastic.

4. The support and mounting bracket as claimed in claim 3, wherein said plastic contains an ultraviolet inhibitor for protecting the bracket from degradation due to prolonged exposure to sunlight.

5. The support and mounting bracket as claimed in claim 1, wherein said body portion is generally rectangular in transverse cross section.

6. The support and mounting bracket as claimed in claim 5, wherein said body portion is about ½ inch wide and about 3/16 inch thick.

7. The support and mounting bracket as claimed in claim 1, wherein said inner end portion is constructed having a transverse bead at lower regions thereof to help retain the inner portion onto the upper edge of the mounting side of the rain gutter.

8. The support and mounting bracket as claimed in claim 1, wherein the outer endd portion of the bracket body portion is formed having an upper ramping surface means which is sloped downwardly and outwardly so as to further enable the bracket outer end portion in being inserted downwardly past an upper, outer edge region of a rain gutter when thhe upper edge of the mounting side of the rain gutter is received into the hooked region of the bracket inner end portion.

* * * * *